US007951052B1

(12) United States Patent
Tang

(10) Patent No.: US 7,951,052 B1
(45) Date of Patent: May 31, 2011

(54) EXERCISE WHEEL

(76) Inventor: Jack Tang, Taipei Hsien (TW)

( * ) Notice: Subject to any disclaimer, the term of this patent is extended or adjusted under 35 U.S.C. 154(b) by 0 days.

(21) Appl. No.: 12/662,209

(22) Filed: Apr. 6, 2010

(30) Foreign Application Priority Data

Dec. 14, 2009 (TW) ..... 98223441 U

(51) Int. Cl.
*A63B 21/00* (2006.01)

(52) U.S. Cl. ..... 482/132

(58) Field of Classification Search ..... 482/132, 482/62, 139, 140, 148, 51, 92
See application file for complete search history.

(56) References Cited

U.S. PATENT DOCUMENTS 6,017,296 A * 1/2000 Tang et al. ..... 482/132
6,196,955 B1 * 3/2001 Chuang ..... 482/132
6,254,518 B1 * 7/2001 Yu ..... 482/140
6,264,587 B1 * 7/2001 Lee ..... 482/132
6,338,703 B1 * 1/2002 Yu ..... 482/132

* cited by examiner

*Primary Examiner* — Lori Baker
(74) *Attorney, Agent, or Firm* — Bacon & Thomas, PLLC

(57) ABSTRACT

An exercise wheel includes a base having a receiving space therein and at least one fan-shaped recession formed at a front bottom side thereof and facing downward; at least one hold bar connected with the base and exposed outside the base; a main wheel rotatably mounted to the base and located in the receiving space; an elastic member mounted between the main wheel and the base for keeping the main wheel restoring after the main wheel is rotated; an auxiliary wheel set rotatably mounted to the base, exposed beneath the base, and engaged with the main wheel to drive the main wheel for rotation; and a steering caster set having a caster frame and a caster, the caster frame being rotatably connected with the base for rotation confined within the fan-shaped recession, the caster being rotatably mounted to the caster frame and partially exposed outside the fan-shaped recession.

11 Claims, 6 Drawing Sheets

EXERCISE WHEEL

BACKGROUND OF THE INVENTION

1. Field of the Invention

The present invention relates generally to fitness apparatuses, and more particularly to an exercise wheel.

2. Description of the Related Art

As shown in FIG. 1, a conventional exercise wheel includes a hollow shaft 81 provided with a slot 82 extending from one end thereof to a midpoint thereof; a volute spring 83 provided with a locating piece 831 confined in the slot 82 of the shaft 81; and two rollers 84 provided at the center thereof with a round hole 85 dimensioned to fit over both ends of the shaft 81. The two rollers 84 are provided with a hollow guide pillar 86 for fastening a bolt 87. One guide pillar 86' is shorter than the other guide pillar 86 for engaging the locating piece 832 of the volute spring 83. In operation, both hands of an exerciser hold two ends of the shaft 81 to roll the roller on a surface in a reciprocating manner. As the wheel is rolled forward, the volute spring 83 is compressed. When the wheel is rolled backward, the wheel is provided by the compressed volute spring 83 with a recovery spring force.

However, the conventional exercise wheel described above includes the following drawbacks in need of improvement.

1. It has only one wheel by which the exerciser can not keep his or her body in balance with ease while moving the body forward or backward, such that it is not convenient for the exerciser to operate the exercise wheel.

2. While the exerciser operates the exercise wheel, the exerciser's body is subject to sideward turnover. If the sideward turnover happens, the exercise may feel nervous or exert overgreat strength to get strain.

Some improved inventions were proposed and had been patented, like U.S. Pat. No. 6,254,518, for the aforesaid conventional exercise wheel. However, it is still not preferable for the exerciser to steer the forward or backward movement of those improved exercise wheels because they did not provide any additional assistance for the exerciser to control their moving directions. For example, the aforesaid '518 patent though provides a front wheel for the exerciser to control the moving direction of the exercise wheel, but an elastic device keeps applying the resilience to interfere the moving direction of the exercise wheel. Besides, it is not limited to change the moving direction of the front wheel. If the moving direction of the exercise wheel is changed by the exerciser involuntarily, the exerciser may get hurt.

SUMMARY OF THE INVENTION

The primary objective of the present invention is to provide an exercise wheel, which allows the user to exercise toward multiple directions.

The secondary objective of the present invention is to provide an exercise wheel, which allows the user to operate it smoothly and conveniently to avoid exercise injury.

The foregoing objectives of the present invention are attained by the exercise wheel composed of a base, at least one hold bar, a main wheel, an elastic member, an auxiliary wheel set, and a steering caster set. The base includes a receiving space therein and at least one Chinese fan-shaped recession formed at a front bottom side thereof and facing downward. The at least one hold bar is connected with the base and exposed outside the base. The main wheel is rotatably mounted to the base and located in the receiving space. The elastic member is mounted between the main wheel and the base for keeping the main wheel restoring after the main wheel is rotated. The auxiliary wheel set is rotatably mounted to the base and exposed beneath the base, and engaged with the main wheel to drive the main wheel for rotation. The steering caster set includes a caster frame and a caster. The caster frame is rotatably connected with the base for rotation confined within the fan-shaped recession. The caster is rotatably mounted to the caster frame and partially exposed outside the fan-shaped recession.

DETAILED DESCRIPTION OF PREFERRED EMBODIMENTS

Figure 1:
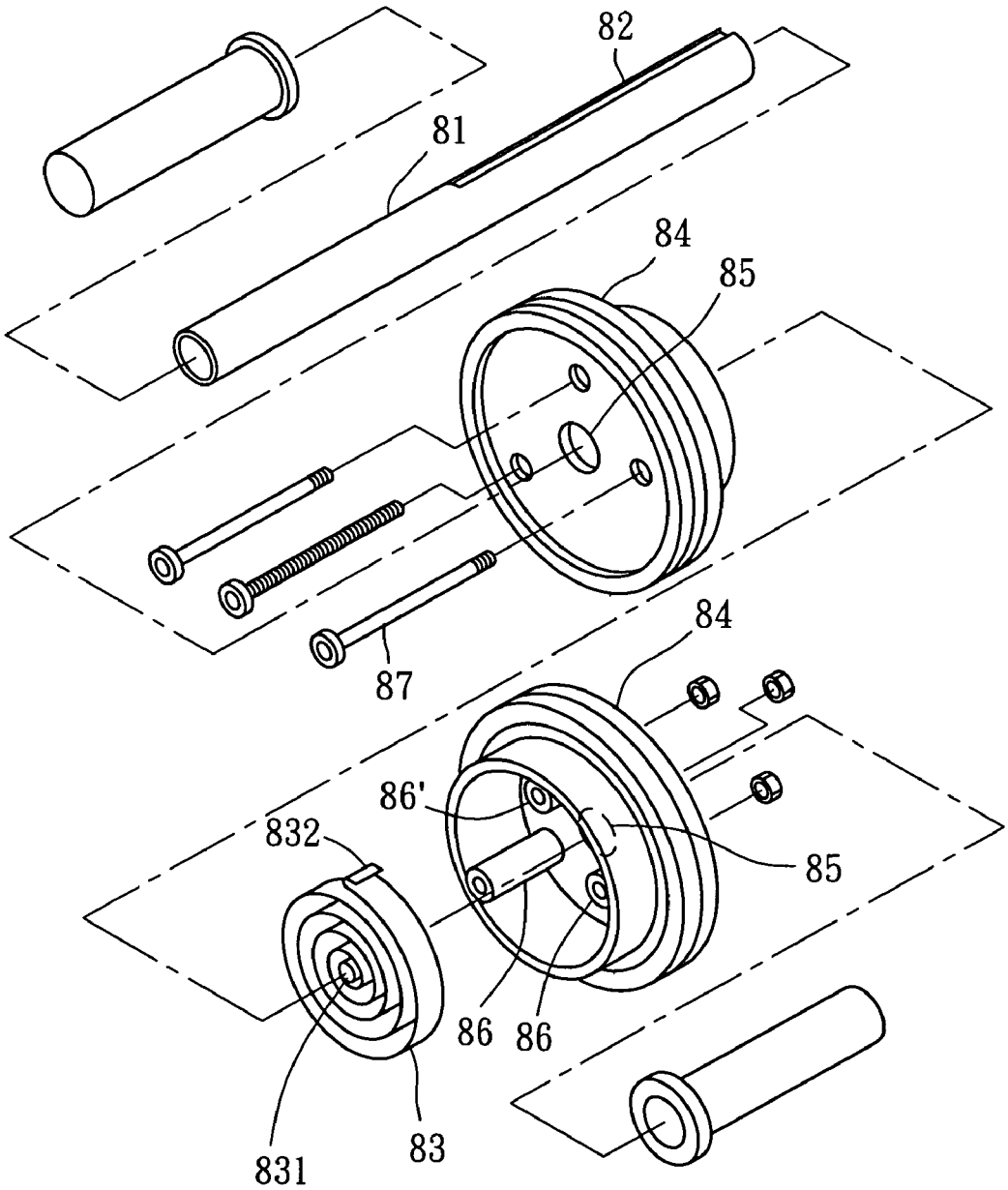
FIG.1 PRIOR ART
FIG. 1 is an exploded view of a conventional exercise wheel.
Figure 2:
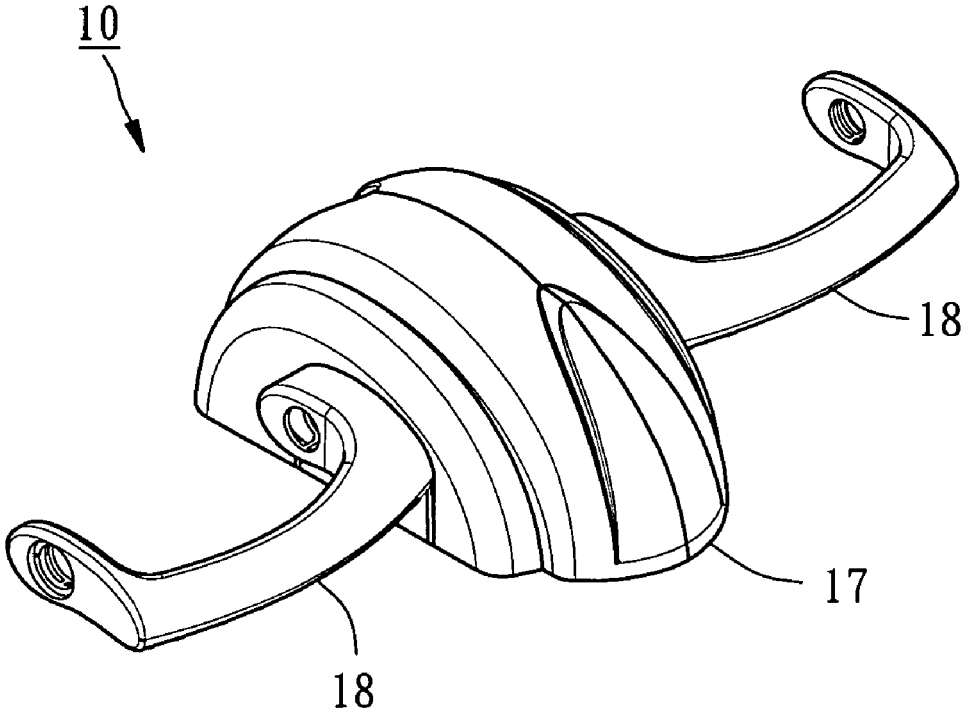
FIG. 2 is a perspective view of first and second preferred embodiments of the present invention.
Figure 2:
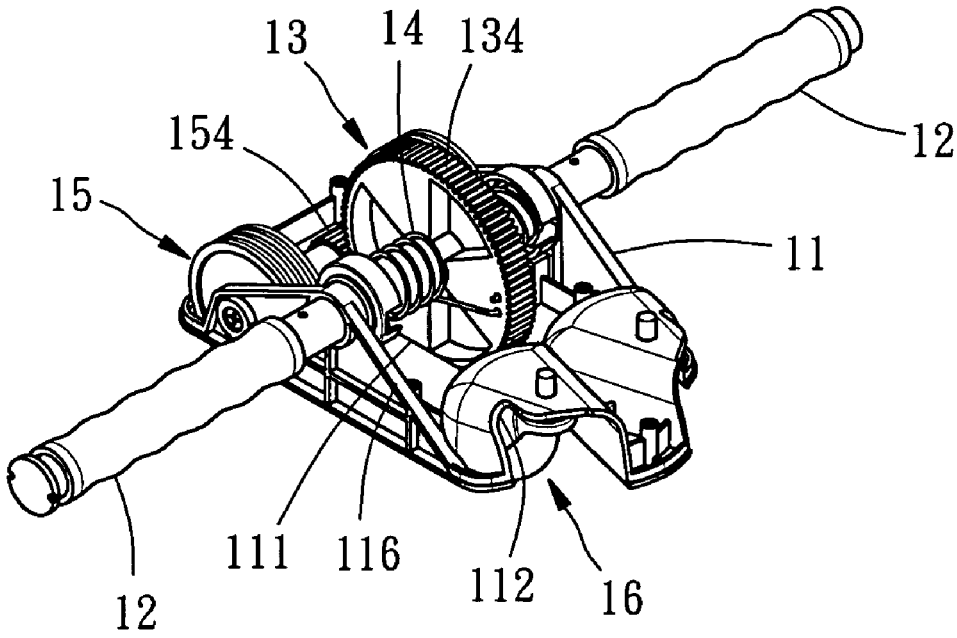
Figure 3:
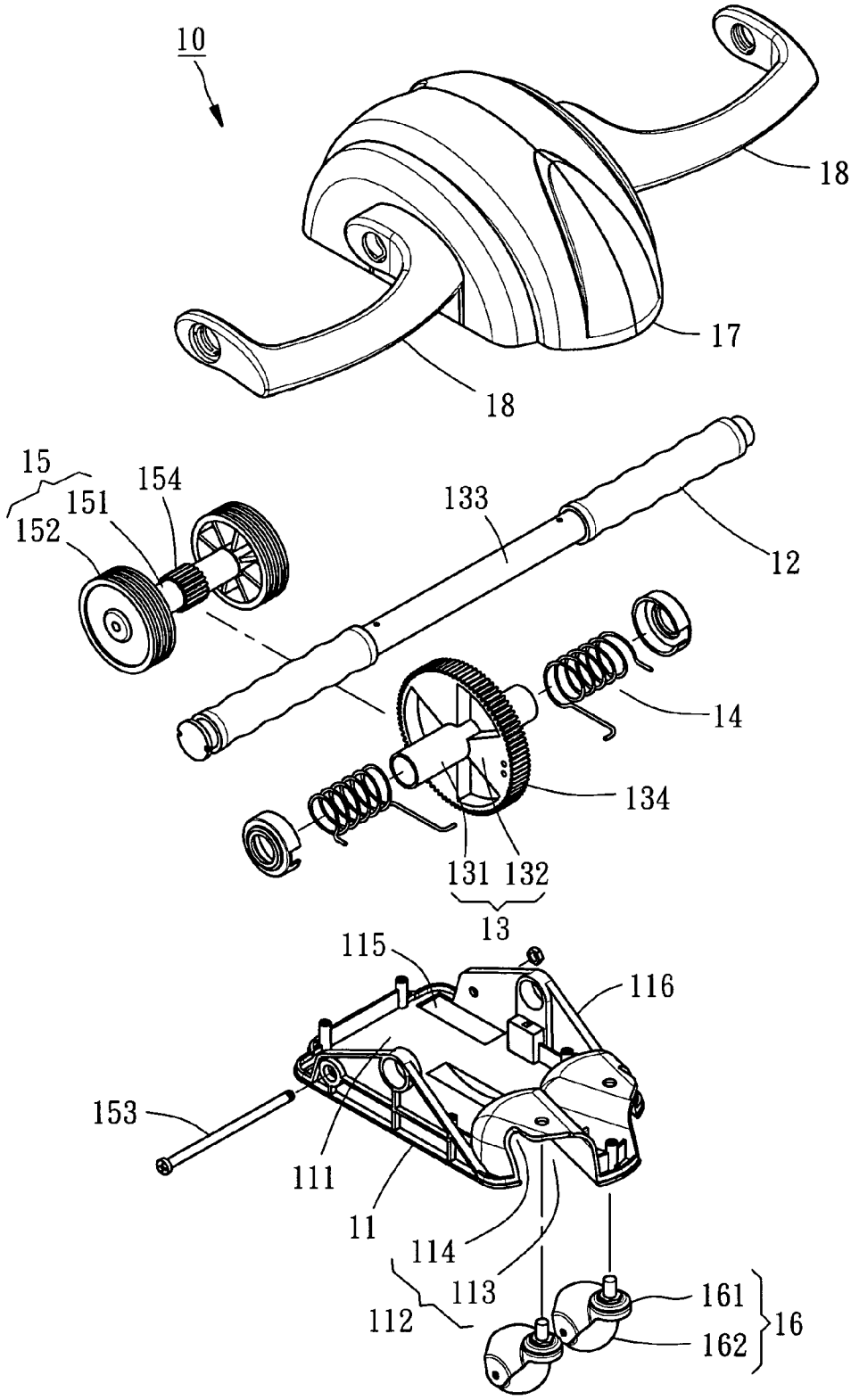
FIG. 3 is an exploded view of the first preferred embodiment of the present invention.
Figure 4:
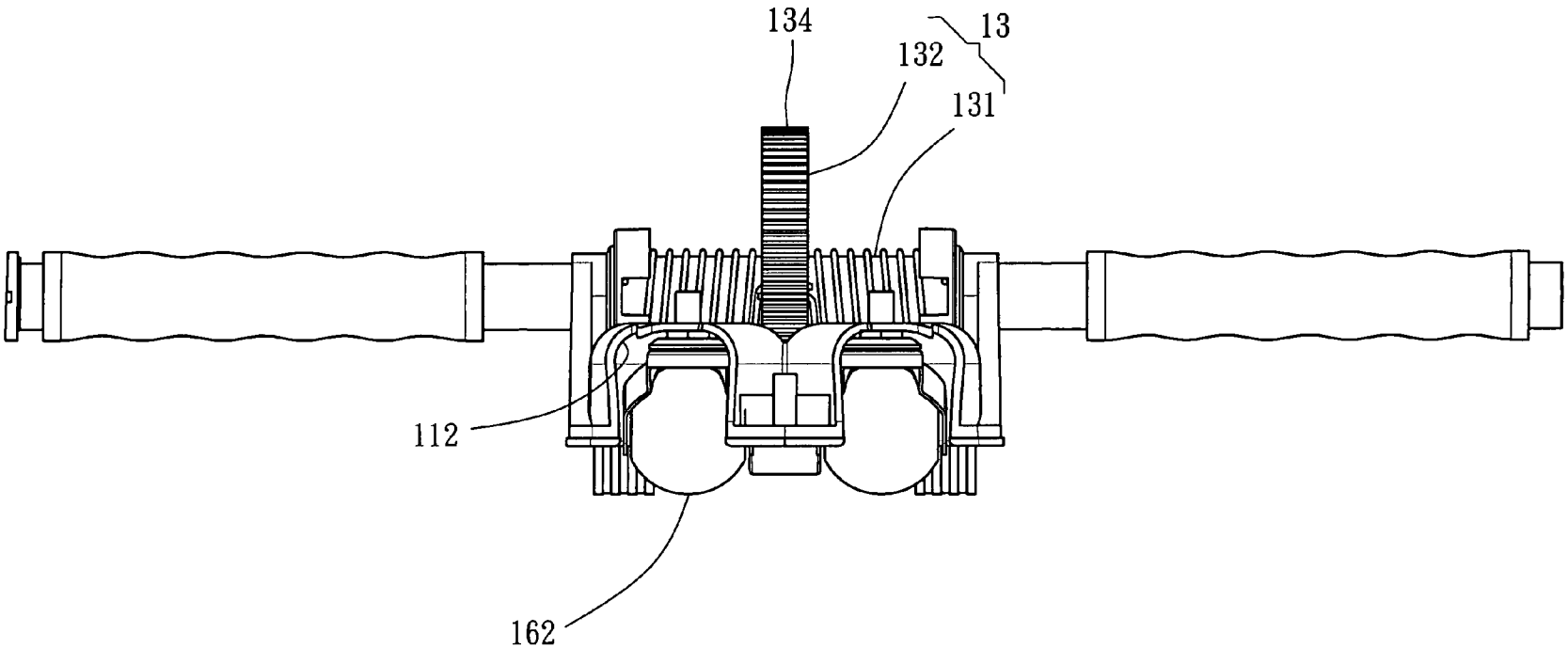
FIG. 4 is a front view of the first preferred embodiment of the present invention.
Figure 5:
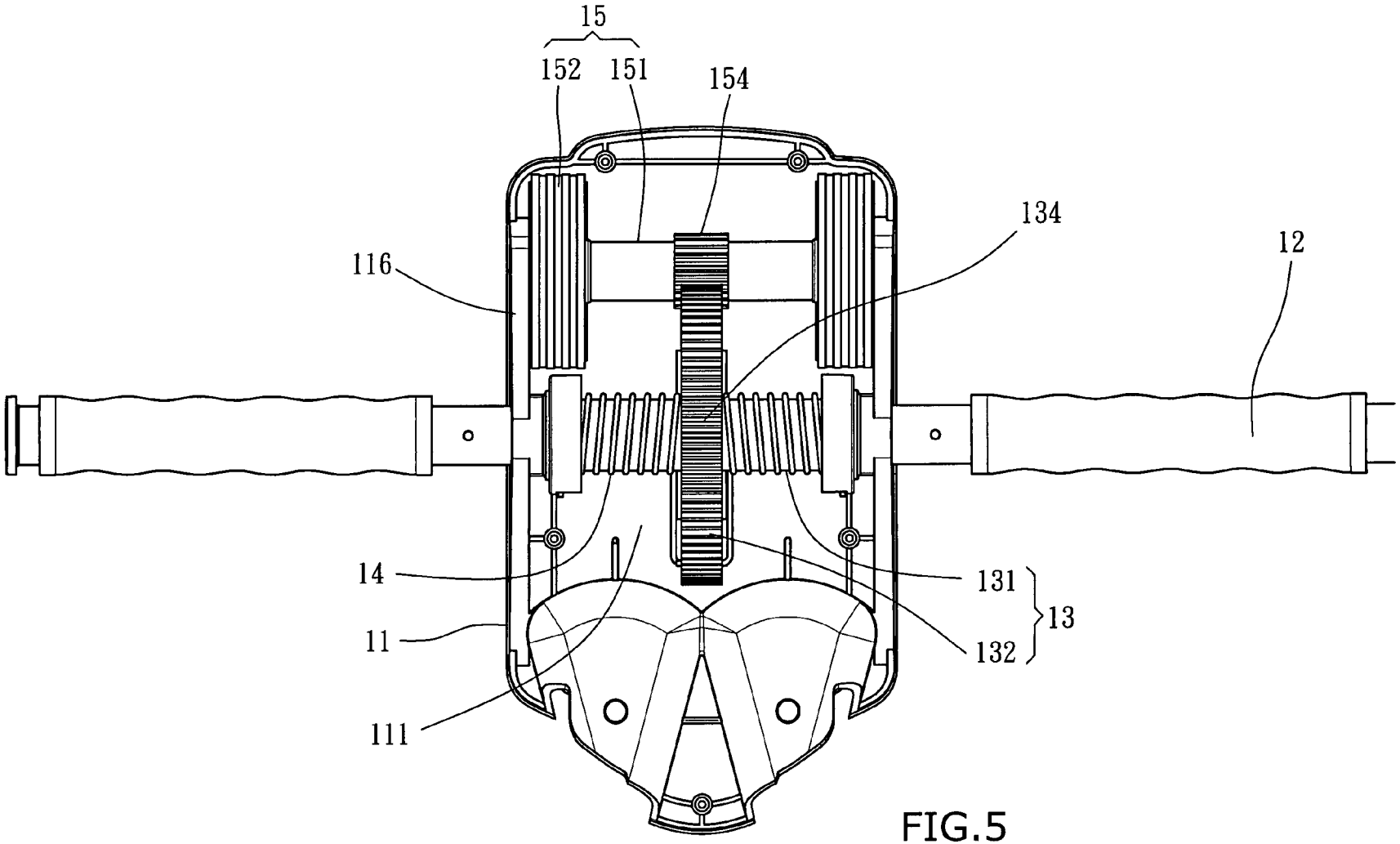
FIG. 5 is a top view of the first preferred embodiment of the present invention.

Referring to FIGS. 2-5, an exercise wheel 10 constructed according to a first preferred embodiment of the present invention is composed of a base 11, two hold bars 12, a main wheel 13, two elastic members 14, an auxiliary wheel set 15, and two steering casters 16.

The base 11 includes a receiving space 111, two Chinese fan-shaped recessions 112, two through holes 115, and two upright walls 116. Each of the fan-shaped recessions 112 defines a relatively narrower portion 113 and a relatively wider portion 114. Each of the upright walls 116 is located at one of two sides of the base 11.

Each of the two hold bars 12 is connected with one of the upright walls 116 and exposed outside the base 11.

The main wheel 13 includes an axial portion 131 and a body portion 132. The main wheel 13 is rotatably mounted to the upright walls by the axial portion 131 and a main shaft 133 and located in the receiving space 11. The body portion 132 of the main wheel 13 has a first engagement teeth 134. The main wheel 13 can be forced for rotation.

Each of the elastic members 14 is a torsion spring in this embodiment and mounted to the axial portion 131 and located between the main wheel 13 and the base 11. One end of the elastic member 14 is fixed to the base 11 and the other end is fixed to the body portion 132. The elastic members 14 can restore the main wheel 13 after the main wheel 13 is rotated. It is to be noted that each of the elastic members 14 can be alternatively mounted to the main shaft 133 in case the axial portion 131 is shortened.

The auxiliary wheel set 15 includes an auxiliary shaft 151 and two auxiliary wheels 152. The auxiliary shaft 151 is rotatably inserted through the upright walls 116 by a screw bolt 153. Each of the two auxiliary wheels 152 is mounted to one of two ends of the auxiliary shaft 151 and exposed beneath the base 11 through the two through holes 115. The auxiliary shaft 151 has a second engagement teeth 154 for engagement with the first engagement teeth 134 of the main wheel 13 for driving the main wheel for rotation.

Each of the steering caster sets 16 includes a caster frame 161 and a caster 162. One end of the caster frame 161 of each steering caster set 16 is rotatably mounted in one of the relatively narrower portions 113 in such a way that the caster frame 161 is confined within one of the Chinese fan-shaped recessions 112. Each of the casters 162 is rotatably connected with the other end of the caster frame 161 and exposed outside the relatively wider portion 114 of one fan-shaped recession 113 to be confined within the relative wider portion 114.

It is to be noted that the hold bars 12 and the main shaft 133 are connected in one piece. Besides, the main wheel 13 can alternatively have a first rough surface (not shown) instead of the first engagement teeth 134, and the auxiliary shaft 151 can alternatively have a second rough surface (not shown) instead of the second engagement teeth 154. The second rough surface 154 of the auxiliary wheel set 15 can frictionally touch the main wheel 13 to drive its rotation.

Figure 6:
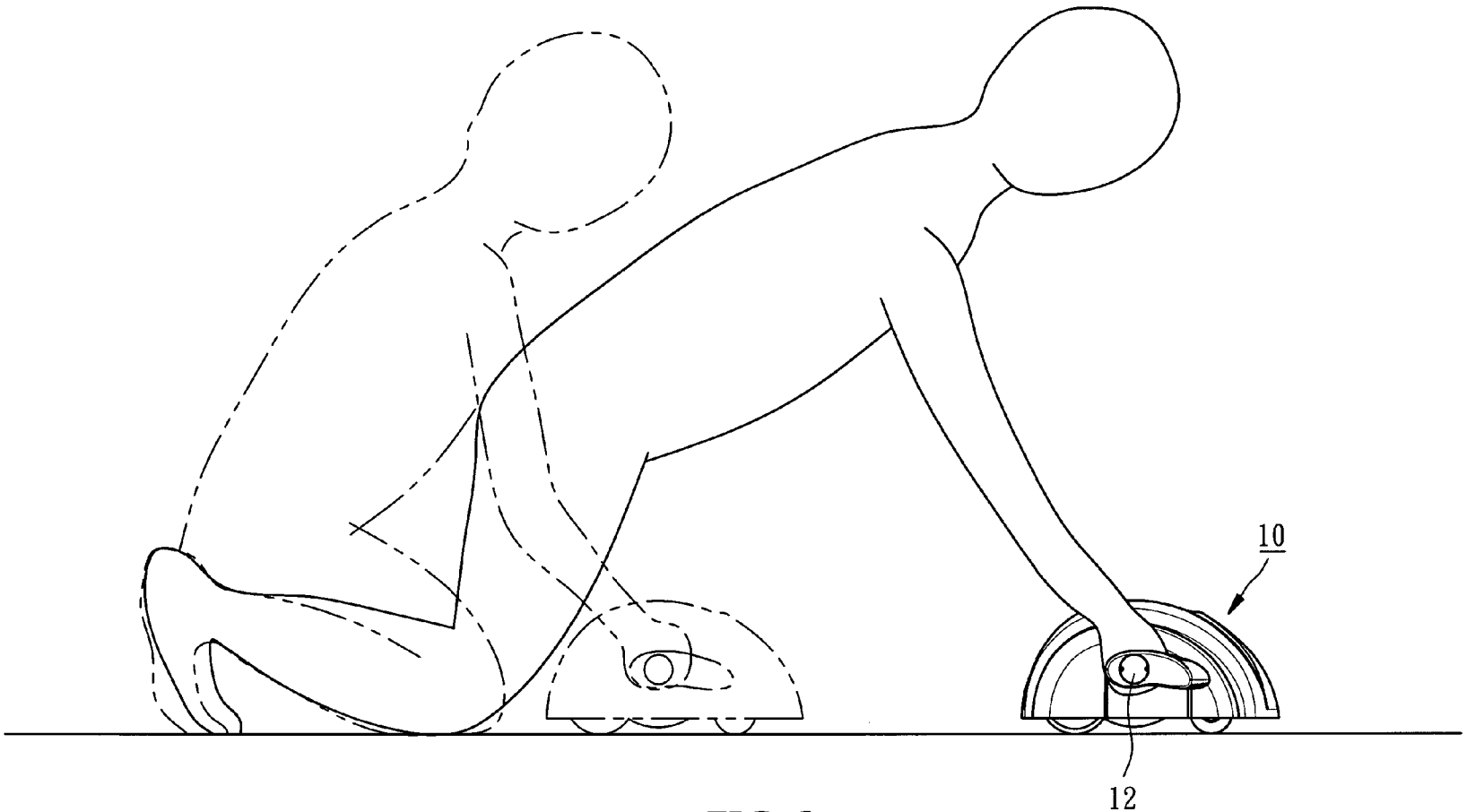
FIG. 6 is a schematic view of the first preferred embodiment of the present invention operated by an exerciser.

In operation, as shown in FIG. 6, the exerciser holds the hold bars 12 and then crouches to put the exercise wheel 10 on the ground, the imaginary line indicating an initial position of the exerciser; meanwhile, each of the auxiliary wheels 152 is stopped against the ground. Next, the exerciser can move the exercise wheel 10 forward from the initial position. In the process of forward rotation of the auxiliary wheels 152 and the auxiliary shaft 151, the main wheel 13 can be driven by the engagement of the first and second engagement teeth 134 and 154 for backward rotation, and meanwhile the end where each elastic member 14 is fixed to the main wheel 13 is rotated backward, thus generating a reverse resilience. FIG. 6 illustrates the status that the exerciser moves the exercise wheel 10 forward for a predetermined distance. On the other hand, when the exerciser intends to move the exercise wheel back to the initial position, the elastic members 14 can help the exerciser restore in such a way that the exerciser can feel easy and smooth. In the process of forward and backward movement of the exercise wheel, the steering caster set 16 can change the moving direction of the exercise wheel without any other external interference as the exerciser intends to do so. Besides, the caster frames 161 are confined within the Chinese fan-shaped recessions 112 separately, such that the exerciser can avoid injury resulting from great change of the moving direction of the exercise wheel 10 while paying no attention to it.

Referring to FIGS. 2-3 again, an exercise wheel constructed according to a second preferred embodiment of the present invention is similar to that of the first embodiment, having the following difference. The exercise wheel further includes a housing 17 and two grip jackets 18. The housing 17 is combined with the base 11. Each of the hold bars 12 is inserted through the housing 17 and exposed outside the housing 17. Each of the two grip jackets 18 includes two ends bending toward the same direction and is fixed to one of the hold bars 12.

Although the operation of the second embodiment is identical to that of the first embodiment, the housing 17 in the second embodiment can further allow the exerciser to safely operate the exercise wheel to avoid accidental injury incurred by the exercise wheel. Besides, the grip jackets 18 are located around the exerciser's hands to protect them from injury caused by either external object.

In conclusion, the exercise wheel of the present invention includes the following advantages.

1. The steering caster set 16 can change the moving direction of the exercise wheel at will. Besides, the auxiliary wheel set 15 has the two auxiliary wheels 152. While operated, the exercise wheel can be stably moved on the ground to and fro rather than the sideward turnover of the prior art. Therefore, the exerciser feels very convenient in operating the exercise wheel and enjoys the pleasure of taking exercise without attentively keeping his or her body in balance 2. The caster frames 161 are confined inside the fan-shaped recession 112 to prevent the exercise wheel 10 from great change of the moving direction while the exerciser pays no attention to it and thus to prevent the exerciser from strain, sprain, or even tumbling. Briefly, the present invention is safer than the prior art in operation.

Although the present invention has been described with respect to specific preferred embodiments thereof, it is in no way limited to the specifics of the illustrated structures but changes and modifications may be made within the scope of the appended claims.

What is claimed is:

1. An exercise wheel comprising:

a base having a receiving space and at least one recession formed at a bottom side of the base and facing downward;

at least one hold bar connected with the base and exposed outside the base;

a main wheel rotatably mounted to the base and located in the receiving space for rotation driven by an external force;

an elastic member mounted between the main wheel and the base for restoring the main wheel after the main wheel is rotated;

an auxiliary wheel set rotatably mounted to the base and exposed under the base, the auxiliary wheel set being connected with the main wheel to drive the main wheel for rotation; and at least one steering caster set having a caster frame and a caster, the caster frame being rotatably connected with the recession of the base and confined within the recession, the caster and the caster frame being rotatably connected with each other, wherein the recession defines a relatively narrower portion and a relatively wider portion; the caster frame comprises two ends, one of which is rotatably connected with the base and located in the recession and the other end is rotatably mounted to the caster, the caster being exposed outside the relatively wider portion and confined within the relatively wider portion for rotation relative to the caster frame.

2. The exercise wheel as defined in claim 1, wherein the at least one fan shaped recession is two in number, the two recessions being formed at front bilateral sides of the base respectively; the at least one steering caster set is two in number, each of the caster frames having one end rotatably connected with one of the recessions.

3. The exercise wheel as defined in claim 1, wherein the main wheel is rotatably mounted to the base by a main shaft and comprises a first engagement teeth; the auxiliary wheel set comprises a second engagement teeth engaging the first engagement teeth for driving the main wheel for rotation.

4. The exercise wheel as defined in claim 3, wherein the elastic member is a torsion spring; the main wheel comprises an axial portion and a body portion, the torsion spring being mounted to the axial portion and having two ends, one of which is fixed to the base and the other end is fixed to the body portion.

5. The exercise wheel as defined in claim 3, wherein the auxiliary wheel set comprises an auxiliary shaft and two auxiliary wheels, each of the auxiliary wheels being mounted to one of two ends of the auxiliary shaft and exposed under the base, the auxiliary wheel set being mounted to the base by a screw bolt inserted through auxiliary wheel set.

6. The exercise wheel as defined in claim 5, wherein the base comprises two through holes; the two auxiliary wheels are exposed through the two through holes under the base.

7. The exercise wheel as defined in claim 5, wherein the base comprises two upright walls, each of which is located at one of two sides; the at least one hold bar is connected with one of the upright walls; the main shaft is connected each of the upright walls; the screw bolt is inserted through the upright walls.

8. The exercise wheel as defined in claim 7, wherein the hold bar and the main shaft are connected in one piece.

9. The exercise wheel as defined in claim 1, wherein the main wheel is rotatably mounted to the base by a main shaft and comprises a first rough surface; the auxiliary wheel set comprises a second rough surface frictionally toughing the first rough surface to drive the main wheel for rotation.

10. The exercise wheel as defined in claim 1 further comprising a housing combined with the base; the at least one hold bar inserted through the housing and exposed outside the housing.

11. The exercise wheel as defined in claim 10 further comprising at least one grip jacket having two ends bending toward the same direction, wherein the at least one grip jacket is fixed to the at least hold bar.

* * * * *